United States Patent [19]

Theobald

[11] Patent Number: 4,543,812

[45] Date of Patent: Oct. 1, 1985

[54] FORGING APPARATUS

[75] Inventor: Donald L. Theobald, Kettering, Ohio

[73] Assignee: The Harris-Thomas Drop Forge Company, Dayton, Ohio

[21] Appl. No.: 638,250

[22] Filed: Aug. 6, 1984

Related U.S. Application Data

[62] Division of Ser. No. 352,191, Feb. 25, 1982, Pat. No. 4,463,590.

[51] Int. Cl.[4] ..... B21D 22/00

[52] U.S. Cl. ..... 72/354; 72/359; 72/360; 29/149.5 B

[58] Field of Search ..... 72/352, 354, 356, 357, 72/358, 360, 372, 375, 374, 344, 467, 359; 403/282, 284, 122, 135; 29/149.5 B

[56] References Cited

U.S. PATENT DOCUMENTS

| | | | |
|---|---|---|---|
| 2,057,669 | 10/1936 | Brauchler | 72/354 |
| 2,627,652 | 2/1953 | Schweller | 72/359 |
| 3,680,354 | 8/1972 | Phillips, Jr. | 72/467 |
| 3,768,295 | 10/1973 | Cudzik | 72/465 |
| 3,914,981 | 10/1975 | Nilsson et al. | 72/467 |
| 4,299,112 | 11/1981 | Kondo et al. | 72/352 |

*Primary Examiner*—Daniel C. Crane
*Assistant Examiner*—David B. Jones
*Attorney, Agent, or Firm*—Jacox & Meckstroth

[57] ABSTRACT

A blank section of a steel rod is heated and then successively impacted between hot forging dies to form a preform or rough forging ball joint socket having a tubular socket portion and a laterally projecting mounting flange portion. The rough forging is then inserted into a die set assembly including an upper die member surrounding a relatively movable punch and a lower die member surrounding a relatively movable ejector member. The upper die member is supported by a piston of a hydraulic cylinder which moves with the punch, and the upper and lower die members cooperate to produce the desired precision external configuration of the socket and flange portions. After the die members are closed, the punch cooperates with the ejector member to form the desired precision internal configuration of the tubular socket portion.

10 Claims, 10 Drawing Figures

FORGING APPARATUS

This is a division of application Ser. No. 352,191 filed Feb. 25, 1982, now U.S. Pat. No. 4,463,590.

BACKGROUND OF THE INVENTION

In the production of ball joint sockets for motor vehicles, usually a blank section of a steel rod or bar is hot forged in successive steps to produce a rough forging including a hollow or tubular socket portion and an outwardly radial flange portion. The rough forging is then commonly machined on an automatic machine tool to the desired precision configuration. Certain types of substantially symmetrical ball joint sockets have also been formed by producing a rough forging from a blank bar section by successive hot forging operations, as mentioned above, and then the rough forging is cold-formed between coining, piercing and trimming dies to form the finished ball joint socket without any machining operation. The ball joint sockets may also be completed or finished with a machining operation following a series of cold forming operations.

It has been found highly desirable to produce a ball joint socket without any machining operations and with a minimum number of cold forming operations while still obtaining the precision dimensions of the finished socket. It is also desirable to eliminate the machining operations and minimize the cold forming operations when producing a ball joint socket having a non-symmetrical configuration. However, none of the prior methods and apparatus for hot forging and cold forming a ball joint socket are usable for producing a non-symmetrical ball joint socket to the required final precision dimensions without requiring machining operations.

SUMMARY OF THE INVENTION

The present invention is directed to an improved method and apparatus for producing a ball joint socket to precision finish dimensions without requiring any machining operations and which is ideally suited for producing a non-symmetrical ball joint socket. The method and apparatus of the invention also minimizes the number of cold forming operations and thereby provide greater dependability by assuring the precision finish dimensions and minimizing the number of scrap or unusual sockets.

In accordance with one embodiment of the invention, a nonsymmetrical ball joint socket having a tubular socket portion and a laterally projecting mounting flange portion is formed by initially hot forging a blank or section of a metal rod to form a rough forging having the general configuration of the desired ball joint socket and with a predetermined flash projecting radially outwardly from the center of the tubular socket portion. The rough forming is then placed between upper and lower die members of cold forming apparatus wherein the upper die member is supported by a piston extending from a hydraulic cylinder mounted on the ram of a mechanical press.

The ram also supports a punch which extends through the center portion of the upper die member, and a lower die member surrounds a cam operated ejector plug. The bottom die member seats on an anvil member and is precompressed within a compression ring which in turn, is precompressed within a surrounding bull ring. The anvil member and compression rings are mounted on a base plate which is secured to the bolster plate of the press. The die members define a cavity which corresponds to the desired precision external dimensions of the ball joint socket, and the lower end portion of the punch conforms to the desired precision internal configuration of the tubular socket portion.

After the forging is placed between the upper and lower die members and the ram is lowered, the hydraulically extended piston and upper die member cold-form or coin the precision external configuration on the ball joint socket. Further downward movement of the ram causes the piston to retract within the cylinder and the punch to enter the tubular portion of the socket and cooperate with the opposing ejector member to form the precision internal configuration or surface of the socket portion. After the cold-formed ball joint socket is removed from between the upper and lower die members, the internal and external flash are trimmed from the tubular socket portion, and holes are punched within the mounting flange portion to complete the finished ball joint socket without requiring any machining operation.

Other features and advantages of the invention will be apparent from the following description, the accompanying drawings and the appended claims.

DESCRIPTION OF THE PREFERRED EMBODIMENT

Figure 1:
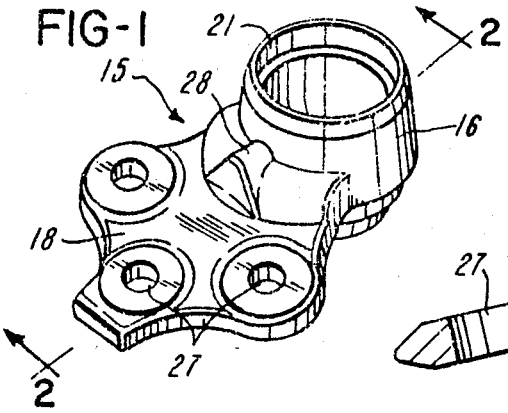
FIG. 1 is a perspective view of a finished precision ball joint socket formed in accordance with the invention without any machining operations.
Figure 2:
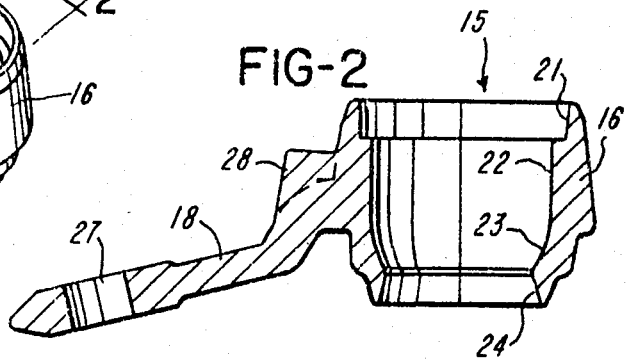
FIG. 2 is a section taken generally on the line 2—2 of FIG. 1.
Figure 3:
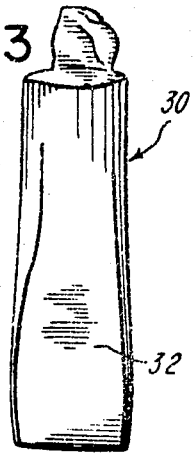
FIG. 3 is a plan view of a blank or steel rod section which is used for producing the ball joint socket shown in FIG. 1.
Figure 4:
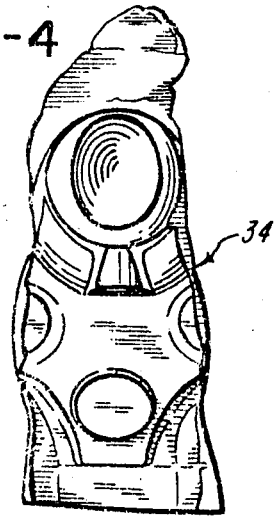
FIGS. 4–7 illustrate generally the progressive hot forging operations for forming a rough forging of a ball joint socket.
Figure 5:
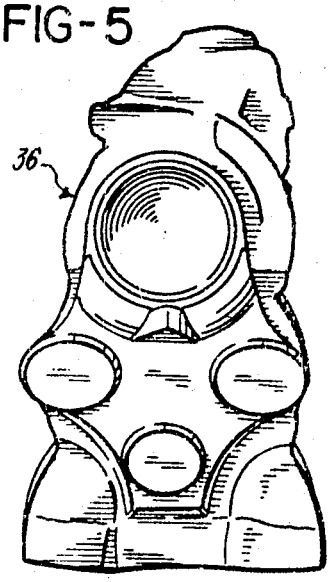
Figure 6:
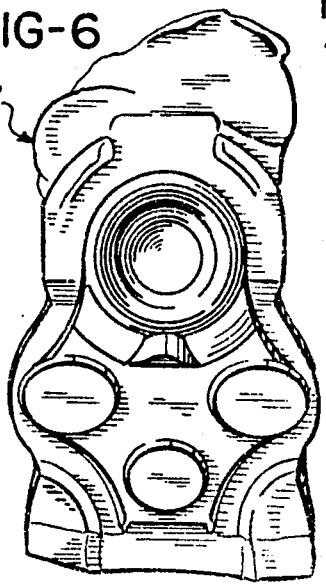

A finished ball joint socket 15 is shown in FIGS. 1 and 2 and includes a tubular or hollow socket portion 16 and in an outwardly projecting mounting flange portion 18. The socket portion 16 includes an annular inner surface 21, a generally cylindrical surface 22 which extends from a part-spherical surface 23 from which extends a frusto-conical surface 24. The flange portion 18 includes three mounting holes 27 and a boss 28 in which is formed a hole (not shown) for receiving a grease fitting. As best shown in FIG. 2, the mounting flange portion 18 projects slightly downwardly from a plane radial to the axis of the tubular socket portion 16.

Figure 7:
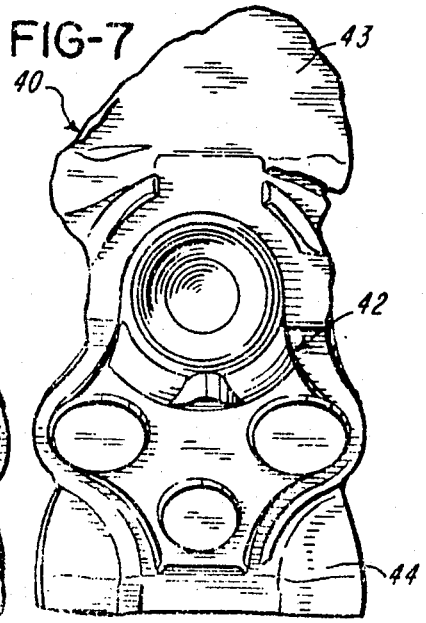
Figure 8:
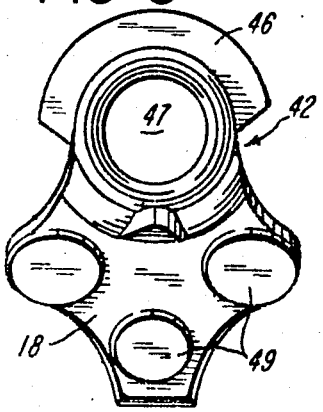
FIG. 8 is a plan view of a rough-forged ball joint socket formed by the progressive steps shown in FIGS. 3–7 and after most of the flash has been trimmed away.

Referring to FIGS. 3–8, the formation of the ball joint socket 15 is commenced by hot forging a heated blank or section 30 of a cylindrical steel rod to form with the first impact a tapered portion 32. The blank 30 is then progressively formed by hot forging dies which include a first rougher impression for producing the rough configurations 34 and 36 shown in FIGS. 4 and 5, and a second rougher impression for progressively forming the hot forged socket configurations 38 and 40 shown in FIGS. 6 and 7. As shown in FIG. 7, the socket configuration 40 defines a rough socket forging 42 which is surrounded by outwardly projecting flash 43 and 44. The flash 44 is trimmed from the rough forging 42 along with most of the flash 43 so that the rough forging 42 retains an arcuate flash portion 46 (FIG. 8). The internal flash within the rough forging 42 is also trimmed to form a pierced hole 47. As also apparent from FIG. 8, the rough socket forging 42 is provided with the three circular pads 49 on the flange portion 18.

After the rough socket forging 42 is formed by the progressive hot-forging steps or operations, the rough forging 42 is normalized by heating the forging to a temperature of approximately 1,650 degrees F. After the rough forging 42 cools, it is lubricated by dipping the forging in a material such as borax. The rough socket forging 42 is provided with the desired precision external and internal dimensions of the socket 15 by placing the lubricated rough forging 42 within a coining die set assembly 55 (FIG. 9) which is installed between a horizontal ram 56 and a horizontal bolster plate 58 of a mechanical press 60.

The die set assembly 55 includes an annular hardened steel upper die member 62 which mates with an annular hardened steel lower die member 64, and the die members 62 and 64 define therebetween a cavity C having the desired precision external configuration of the ball joint socket 15. The upper die member 62 is pressed into a bore 67 formed within an annular piston 68. The piston 68 is enclosed within an annular cylinder 72 within which the piston 68 may move on a vertical axis a limited distance of about one inch. A set of peripheral grooves 73 are formed on the piston 68 and receive corresponding sealing rings (not shown) which form fluid-tight sliding seals between the piston 68 and the cylinder 72. The cylinder 72 is closed on its upper end by a circular base 76 which is rigidly secured to the cylinder 72 by peripherally spaced screws 77 and rigidly secured to the vertically movable ram 56 of the press 60 by a set of bolts 78 and T-nuts 79 located within parallel spaced T-slots 81 within the ram 56.

The base closure plate 76 for the cylinder 72 has a downwardly projecting center or hub portion 84 which supports a hardened steel punch 85 adapted to move axially within the center of the upper die member 62. The punch 85 is retained by a retaining ring 87 and peripherally spaced screws 88 so that the punch 85 moves vertically with the ram 56 of the press 60. The punch 85 has a lower end portion 90 which has a precision external configuration corresponding to the desired precision internal surfaces 21–23 within the socket portion 16. A set of circumferential grooves 93 extend around the hub portion 84 and receive corresponding sealing rings (not shown) which form a fluid-tight seal between the piston 68 and the hub portion 84 of the cylinder closure plate 76. A dowel pin 96 prevents rotation of the upper die member 62 relative to the piston 68, and a guide pin 98 receives a sleeve bearing 99 within the piston 68 for preventing any rotation of the piston 68 relative to the cylinder closure plate 76.

The lower hardened steel die member 64 seats on an annular anvil member 104 which, in turn, seats on the press bolster plate 58 and has an upper frusto-conical or tapered surface 106. The annular lower die member 64 is precompressed into a cylindrical sleeve 108 which also seats on the tapered surface 106, and the sleeve 108 is precompressed or press-fitted into a surrounding compression ring 110. The assembly of the lower die member 64, sleeve 108 and compression ring 110 is press-fitted into a bull ring 112 which seats on a square bottom mounting plate 114 surrounding the anvil 104. The mounting plate 114 is secured to the bolster plate 58 by another set of bolts 78 and T-nuts 79 which are confined within the parallel spaced T-slots 81 within the bolster plate 58. A set of C-shaped clamp members 118 and bolts 119 secure or clamp the bull ring 112 to the base plate 114, and a locating pin 121 prevents rotation of the lower die member 64 relative to the anvil 104.

The bolster plate 58 has a center opening or bore 123 which receives a vertically movable ejector member 124. The ejector member 124 is cam operated in timed relation to vertical movement of the ram 56 and supports an ejector plug 126 secured to the member 124 by a threaded coupling 127. The upper end portion of the ejector plug 126 has a frustoconical or tapered end surface 129, and a slight clearance space is defined between the upper end of the ejector plug 126 and the lower end of the punch 85 when the ejector plug is in its seated position and the punch is in its lowermost position.

The downward force exerted by the ram 56 of the mechanical press is on the order of several hundred tons, for example, 500 to 600 tons. Hydraulic fluid is supplied to the cylinder 72 behind the piston 68 through a passage 132 formed within the cylinder closure plate 76. Preferably the hydraulic fluid is supplied at a pressure on the order of 3,000 psi in order to produce a downward force on the piston 68 of approximately one-half the downward force exerted by the ram 56, or on the order of about 250 tons. The passage 132 is connected to a hydraulic accumulator (not shown), and the passage is sufficiently large to permit a substantial flow rate, for example, on the order of 280 gallons per minute into and out of the cylinder chamber above the piston 68.

Figure 10:
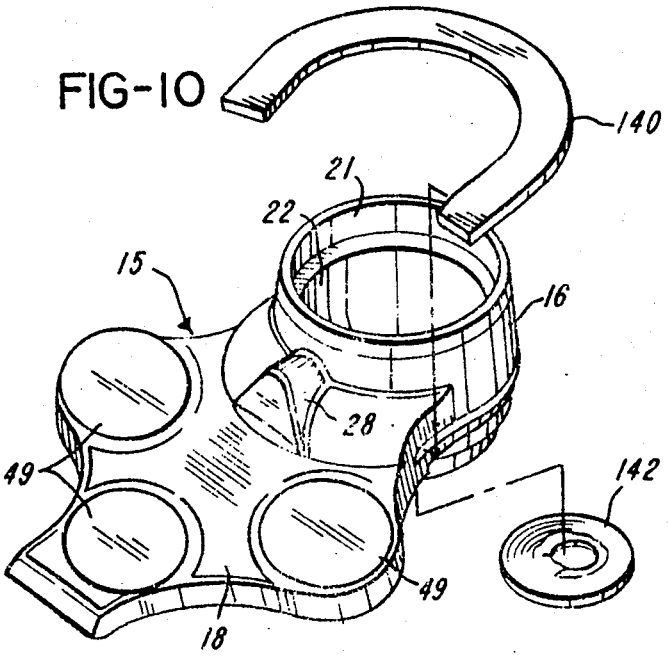
FIG. 10 is a perspective view of the precision ball joint socket produced by the apparatus shown in FIG. 9 and illustrating the trimming operation to remove external and internal flash.

When the ram 56 is retracted upwardly, the hydraulic pressure within the passage 132 is effective to extend the piston 68 and the supporting upper die member 62 with a substantial force such as 250 tons, mentioned above. When the upper die member 62 is retracted upwardly to its open position, a preformed or rough forging 42 (FIG. 8) is placed within the die cavity C within the lower die member 64. As the ram 56 lowers, the hydraulically extended upper die member 62 cold forms or coins the rough forging 42 into the desired precision external configuration of the socket 15, as shown in FIG. 10 before the holes 27 are punched.

Figure 9:
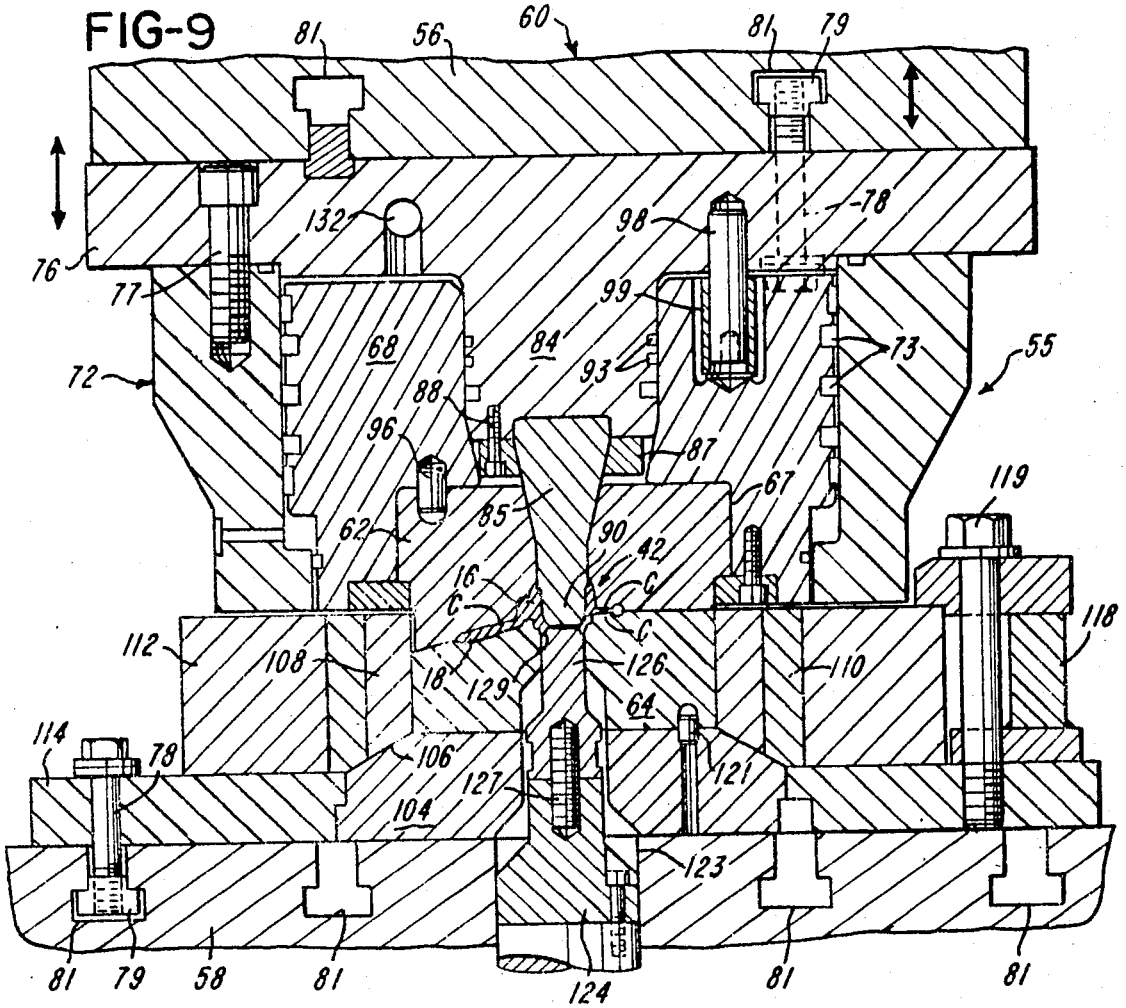
FIG. 9 is a vertical section through a die set assembly mounted on a mechanical press and which receives the rough forging shown in FIG. 8 and cold-forms the forging into the ball joint socket with precision external and internal configurations.

As the ram 56 continues with its downward stroke, the punch 85 enters the socket portion 16 and cooperates with the ejector plug 126 to form the precision inner surfaces 21–24 within the socket portion 16, as shown in FIGS. 2 and 9. As also shown in FIG. 9, the cavity C defined between the upper die member 62 and the lower die member 64, includes a cavity portion which receives the flash portion 46 of the rough forging 42 and also any excess metal which is produced when the punch 85 enters the tubular socket portion 16. The flash portion 56 on the rough forging 42 is desirable to help balance the loading and stresses within the die members since the flash portion 46 is generally diametrically opposed to the flange portion 18.

When the ram 56 is retracted upwardly, the punch 85 retracts from the socket portion 16 while the upper die member 62 remains closed in response to the substantial hydraulic pressure behind or above the piston 68. As the ram 56 continues to retract upwardly, the upper die member 62 retracts from the lower die member 64 to expose the cold-formed or coined sockets 15 (FIG. 10). The ejector plug 126 is then elevated by a cam actuation of the ejector member 124, and the socket 15 is ejected from the cavity within the lower die member 64. After the cold-formed socket 15 is removed from between the die members, the final operations include trimming of the U-shaped external flash portion 140 and the circular internal flash portion 142 from the socket 15, as shown in FIG. 10, after which the holes 27 are punched.

From the drawings and the above description, it is apparent that the method and apparatus for constructing a ball joint socket in accordance with the invention, provide desirable features and advantages. For example, by initially hot forging the blank 30 with progressive hot forging dies to form the preform or rough forged socket 42, and then precisely coining or cold-forming the rough forged socket 42 into the finished socket 15 with the die set assembly 55, the ball joint socket 15 is completely finished to precision dimensions without requiring any machining operations. As mentioned above, the upper die member 62 and lower die member 64 cooperate to form the precision external configuration of the socket 15, after which the punch 85 cooperates with the ejector plug 126 to form the precision internal surfaces within the socket portion 16.

The constant hydraulic pressure within the passage 132 and behind the piston 68 assures that the rough forged socket 42 is confined within the cavity C while the punch 85 enters and retracts from the socket portion 16 during each cycle of the ram 56. The cavity C also provides for the movement of excess metal into the formation of the external flash 140 and into internal flash 142 between the opposing ends of the punch 85 and ejector plug 126. The precompression of the lower die member 64 within the sleeve 108, compression ring 110 and bull ring 112 also maintains the precision dimension of the lower die member 64 during the high pressure cold-forming operation and thereby assures the precision tolerances desired within the ball joint socket 15. Thus the method and apparatus of the invention provide for producing precision ball joint sockets more efficiently and more economically.

While the method and form of apparatus herein described constitute a preferred embodiment of the invention, it is to be understood that the invention is not limited to the precise method and form of apparatus described, and that changes may be made therein without departing from the scope and spirit of the invention as defined in the appended claims.

The invention having thus been described, the following is claimed:

1. Forging apparatus adapted to be mounted on a press having a ram movable relative to a bolster plate and for producing a forged metal part such as a ball joint socket, said apparatus comprising a die set assembly including a first annular die member and a mating second die member, said first die member being movable with said ram between a retracted position and a closed position relative to said second die member, said die members cooperating in said closed position to define a cavity corresponding in configuration with the desired external shape of the part, a hydraulic cylinder including a movable annular piston, means for rigidly securing said cylinder to said ram, said cylinder including a center hub portion movable with said ram and projecting into said annular piston, means for rigidly and removably securing said first annular die member to said annular piston, a punch removably mounted on said hub portion of said cylinder and projecting through said first annular die member to said cavity, support means rigidly securing said second die member to said bolster plate, and means for supplying hydraulic fluid to said cylinder for extending said piston and said first die member relative to said punch and providing for retraction of said piston and said first die member under substantial hydraulic pressure in response to continued movement of said punch with said ram after said die members move to said closed position.

2. Apparatus as defined in claim 1 wherein support means for said second die member include a compression ring surrounding said second die member, and said second die member is precompressed into said ring.

3. Apparatus as defined in claim 2 wherein said support means further comprise an anvil member mounted on said bolster plate and supporting said second die member, and said compression ring is supported by said anvil member.

4. Apparatus as defined in claim 1 wherein said second die member is annular, an ejector plug projecting through said second die member to said cavity and in opposed relation to said punch, and means for moving said ejector plug within said second die member in timed relation with the operation of said press.

5. Apparatus as defined in claim 4 and including an annular anvil member mounted on said bolster plate and surrounding said ejector plug, and said second die member is mounted on said anvil member.

6. Apparatus as defined in claim 5 wherein said anvil member has a frusto-conical support surface, a compression ring mounted on said support surface and surrounding said second die member in precompressed relation.

7. Apparatus as defined in claim 6 and including a bull ring surrounding said compression ring, and a base support plate surrounding said anvil member and supporting said bull ring.

8. Apparatus as defined in claim 4 wherein said ejector plug has an end surface cooperating with said cavity for forming a predetermined surface on the part.

9. Apparatus as defined in claim 1 wherein said punch has a part-spherical end surface for producing a part-spherical surface within the part.

10. Forging apparatus adapted to be mounted on a press having a ram movable relative to a bolster plate and for producing a forged metal part such as a ball joint socket, said apparatus comprising a die set assembly including a first annular die member and a mating second die member, said first die member being movable with said ram between a retracted position and a closed position relative to said second die member, said die members cooperating in said closed position to define a cavity corresponding in configuration with the desired external shape of the part, a hydraulic cylinder including an annular section surrounding an annular piston movable within said annular section, said cylinder further including a base section removably secured to said annular section, means for rigidly securing said base section to said ram, said base section including a hub portion movable with said ram and projecting into said annular piston, means for rigidly and removably securing said first annular die member to said annular piston, a punch removably mounted on said hub portion and projecting through said first annular die member to said cavity, support means rigidly securing said second die member to said bolster plate, and means for supplying hydraulic fluid to said cylinder for extending said piston and said first die member relative to said punch and providing for retraction of said piston and said first die member under substantial hydraulic pressure in response to continued movement of said punch with said ram after said die members move to said closed position.

* * * * *